United States Patent [19]

Marechal

[11] Patent Number: 4,572,303

[45] Date of Patent: Feb. 25, 1986

[54] MACHINE FOR EXTRACTING, ROUGH SHAPING AND SQUARING BLOCKS OF STONES, MARBLES AND GRANITES, PARTICULARLY IN QUARRIES

[75] Inventor: Roger Marechal, Nuits sur Armancon, France

[73] Assignee: Rocamat, Puteaux, France

[21] Appl. No.: 512,543

[22] Filed: Jul. 11, 1983

[30] Foreign Application Priority Data

Jul. 21, 1982 [FR] France ..... 82 12722

[51] Int. Cl.[4] ..... E21B 15/04

[52] U.S. Cl. ..... 173/39; 173/42; 173/44; 299/55; 299/75; 37/80 A; 37/191 A

[58] Field of Search ..... 173/43, 42, 39, 44; 37/191 A, 80 A, DIG. 13, DIG. 16; 299/55, 77, 75

[56] References Cited

U.S. PATENT DOCUMENTS

| | | | |
|---|---|---|---|
| 1,978,366 | 10/1934 | Levin | 299/71 |
| 3,061,290 | 10/1962 | Sibley | 299/75 |
| 4,022,410 | 5/1977 | Ewart et al. | 173/43 X |
| 4,126,083 | 11/1978 | Haak et al. | 173/43 X |
| 4,230,372 | 10/1980 | Marten | 173/43 X |

*Primary Examiner*—E. R. Kazenske
*Assistant Examiner*—Willmon Fridie, Jr.
*Attorney, Agent, or Firm*—Ralph H. Dougherty

[57] ABSTRACT

The machine comprises an automobile vehicle provided with a pivoting boom to which is pivotably mounted a beam carrying a pivotally mounted swingle-bar to which is coupled a rotary plate for supporting a frame provided with guiding uprights for a sawing unit. Hydraulic cylinders and motors are provided for adjusting respective positions of the boom, beam, swingle-bar, rotary plate and motor means of the sawing unit. Means are provided to maintain the frame in a fixed position when working a sawing step.

6 Claims, 3 Drawing Figures

MACHINE FOR EXTRACTING, ROUGH SHAPING AND SQUARING BLOCKS OF STONES, MARBLES AND GRANITES, PARTICULARLY IN QUARRIES

BACKGROUND OF THE INVENTION

The present invention relates to stone working and more particularly to quarry extraction. In this technique, it is necessary to cut stone blocks of great sizes directly in the quarry mass.

The state of art is illustrated by patents DE-A No. 2 205 347, DE-C No. 858 963, FR-A No. 1 491 226, U.S. Pat. No. 3,954,301, DE-B No. 2 113 190 and U.S. Pat. No. 1,978,366 which describe mobile or stationary working devices for making works into a ground or for cutting various mineral products.

Stone working was till now very painful and difficult to make since it necessitated either a continuous manual handling or a positioning of a stationary apparatus enabling to make only a single saw cut, this apparatus having then to be dismantled, displaced and repositioned for making a second saw cut. The extraction times were thus very long which increases the cost of the product so obtained.

SUMMARY OF THE INVENTION

The present invention provides for a new machine which makes possible to carry out sawing in an entirely mechanical way and in a great plurality of positions without being necessary to proceed to any mounting or dismounting steps. Moreover controlling of the sawing steps is set by a single operator which is in a cab which can easily be conditioned so that the working conditions are comfortable and in any way free of dust.

The machine of the invention enables further to work either at the ground level or at a height of several yards above the ground level, and even under the ground level when cuts are to be made in excavations.

According to the invention, the machine for extracting, rough shaping and squaring stones, particularly in quarries, comprises an automobile vehicle provided with a pivoting boom to which is pivotally mounted a beam carrying a pivotally mounted swingle-bar to which is coupled a rotary plate for supporting a frame provided with guiding uprights of a sawing unit, hydraulic cylinders and motors being provided for adjusting respective positions of the boom, beam swingle-bar, rotary plate and motor means of the sawing unit.

Various other features of the invention will be revealed from the following detailed description.

BRIEF DESCRIPTION OF THE DRAWINGS

An embodiment of the invention is shown as a non limitative example in the accompanying drawings, wherein.

DESCRIPTION OF THE PREFERRED EMBODIMENT

Figure 1:
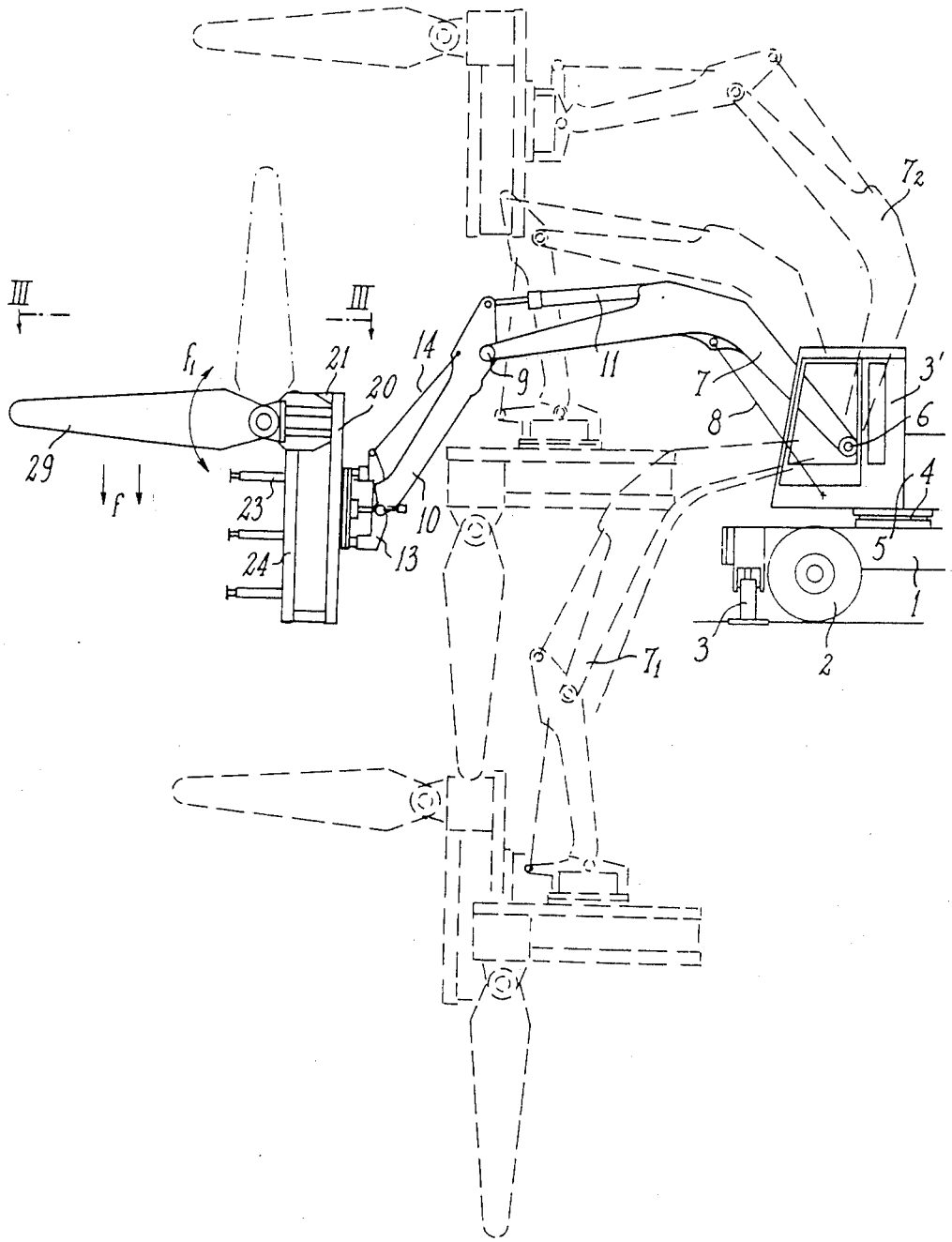
FIG. 1 is a diagrammatic elevation view of the machine according to the invention for extracting, rough shaping and squaring stone blocks, and illustrating various working positions.

As shown in FIG. 1, the machine of the invention comprises an automobile body 1 which, in the example illustrated in the drawings, is provided with wheels 2, but which could in the same way comprise caterpilar tracks. The body 1 is provided with stabilizers 3 which are brought down to the ground during the working steps. The automobile body 1 carries, through a rotary plate 4, a jig 5 on which is mounted, through a pin 6, a boom 7 whose inclination is controlled between two end positions $7_1$ and $7_2$ by means of a cylinder diagrammatically shown at 8. The boom 7 carries at its tip end, through a pin 9, a beam 10 the angle of which with the boom 7 is adjustable by means of a cylinder 11.

The beam 10 comprises by a lever having one end connected to the cylinder 11, the other end of the lever carrying through an articulation 12 (FIG. 2) a swingle-bar 13 which is besides connected to the beam 10 by a cylinder diagrammatically shown at 14.

The swingle-bar 13 forms a yoke having arms 15, **15*a* which carry, through pins 16, stationary parts 17*a* supporting a rotary plate 17**.

A trim adjusting cylinder 18 (FIGS. 2 and 3) connects the stationary parts **17*a* supporting the rotary plate 17 to the swingle-bar 13. The rotary plate 17 is provided with a rotation control motor 19 (FIG. 3) which is similar to that used for driving the rotary plate 4 of the jig 5** and which is not shown in the drawings.

The rotary plate 17 carries a frame 20 which maintains a second frame 22 through cross-beams 21, the second frame 22 having a front face carrying bearing cylinders 23.

The second frame 22 comprises side uprights 24 having a square cross-section and provided with bearing parts **24*a* at their lower parts. Two of the edges of each of the side uprights 24 are used as guides for rollers 25 carried by a body 26 which can be moved between the cross-beams 21. The movement of the body 26 with respect to the guide forming side uprights 24 is controlled by a motor (not shown) contained therein and which drives suitable components, for example a gear engaging with racks or with chains or other means known in the art for enabling the move at a controlled speed of the whole body 26 from one of the cross-beams 21** to the other.

Figure 2:
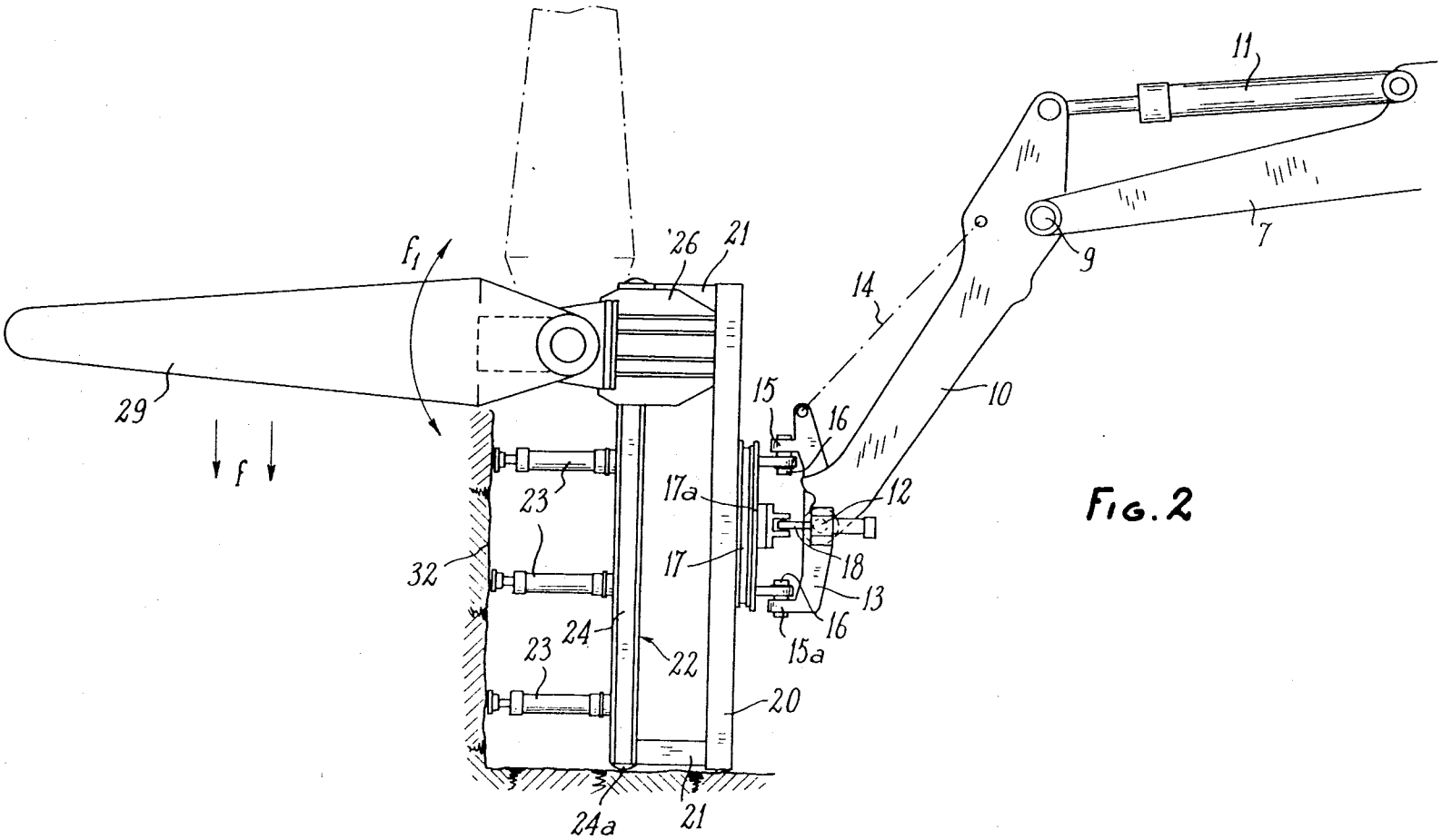
FIG. 2 is an enlarged and partly diagrammatic elevation view of a working unit of the machine of FIG. 1.
Figure 3:
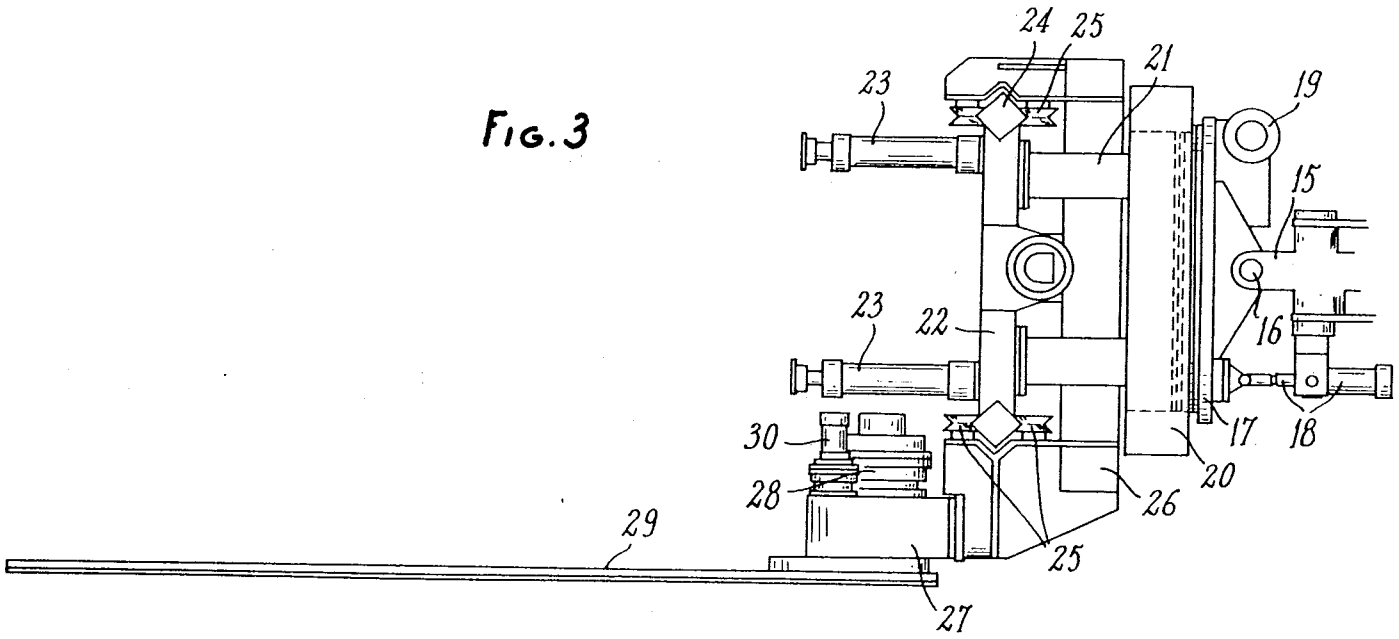
FIG. 3 is a plan view substantially taken according to line III—III of FIG. 1.

As better shown in FIG. 3, the body 26 carries on one of its side a motor means 27 comprising a first motor 28 for driving a cutting chain 29 well known in the art of sawing stones and marbles, and a second motor 30 enabling to pivot the cutting chain according to arrow $f_1$ (FIG. 2) on a range at least equal to 90°. Therefore, the cutting chain and the means supporting the cutting chain can be provided vertically or horizontally as shown at the left of FIG. 2.

All the above described motors are preferably hydraulic motors which enables to provide control thereof through distributors placed in the control cab 3' of the carrier vehicle, and to use the same hydraulic central unit for feeding the motors, and the cylinders.

As shown in the drawings, the machine can be used for a work in a great plurality of positions. In the position shown in FIGS. 1 and 2, the machine may make a vertical cut in a stone block to be cut in a quarry. In this case the automobile body 1 is carried by the stabilizers 3, and the boom 7 as well as the beam 10 are adjusted by their respective cylinders 11 and 14 for bringing the frame 22 in a vertical position and in order that the bearing parts **24*a* will bear on the ground. The trim adjusting cylinder 18 is possibly actuated so that the frame 22 will extend as parallely as possible to the wall 32 in which the cutting chain 29** must work.

If the ground is not perfectly plane, or for other reasons for example if it is the automobile body which is not horizontal, the rotary plate 17 is preliminary actuated in order that the bearing parts 24*a* are correctly applied on the ground. At the end of these adjustments, the cylinders 23 are controlled for bearing on the wall 32 of the quarry and, in the same time, an application force is transmitted to the bearing parts 24*a* through the cylinders 14, 11 and/or 8. There is thus ensured a great stability of the frame supporting the body 26 on which are mounted the cutting chain and its motor means.

The above mentioned controls can be made while the cutting chain 29 is in a vertical position and, in this later case, a first working operation will consist to pivot the cutting chain 29 for returning it in an horizontal position, this first stroke providing a sawing step if the wall 32 is high or being only used for positioning the sawing chain if cuts have already been made above the position occupied by the cutting chain 29 in FIG. 2.

The cutting operation consists then to lower the cutting chain 29 according to arrow f, i.e. to lower the body 26 along the side guiding uprights 24.

If an horizontal cut has to be made, the rotary plate 17 is turned by 90° before the cylinders 23 are accosted against a wall 32 of the quarry. The work is thereafter the same as that described in the above disclosure.

FIG. 1 shows that the movement of the boom 7 and beam 10 enables to make working steps at a great plurality of positions either very much above the level of the ground on which are placed the stabilizers 3 (position $7_2$ of the boom), or very much under the ground, for example in a trench (position $7_1$ of the boom).

In all these positions, it is possible to suitably adjust the guiding uprights 24 by acting not only on the cylinders controlling the boom and the beam but also on the cylinders controlling the swingle-bar 13 and the stationary part 17*a* of the rotary plate 17, which enables in each case to make cuts in vertical or horizontal positions, or cuts with pre-determined angles, and that with a very great accuracy even if the stabilizers 3 of the automobile body 1 are not placed on an horizontal ground.

Having fully described the invention and wishing to cover those modifications and variations which would be apparent to those skilled in the art, without departing from either the scope or spirit thereof,

I claim:

1. A rock cutting machine, comprising:

an automotive vehicle;

a pivotable boom mounted for pivotal movement on said vehicle;

a beam pivotally mounted on said boom and carrying a swingle bar at the end of said beam remote from said boom;

said swingle bar being pivotally mounted on said beam at about the center of said swingle bar, said swingle bar being in the form of a yoke having arms, each arm carrying coupling means;

a rotatable plate coupled to said swingle bar through said coupling means;

a first frame affixed to said rotatable plate;

a second frame spaced from said first frame, and fixed to said first frame by cross beams, said second frame having longitudinal side members of square cross section oriented as guide members, with the closest portions of said side members to each other being edges;

a sawing unit comprising a cutting chain, a motor connected to and adapted to drive said cutting chain, a base supporting both said cutting chain and said motor, and guide wheels journaled in said base for engagement with said guide members, the wheels, base, and associated cutting chain being moveable along said guide members;

means mountable on said vehicle for maintaining the vehicle in a fixed position on the ground;

adjusting means for adjusting the respective position of said boom, beam, swingle bar, rotary plate and sawing unit; and means for maintaining the second frame in a fixed position during a cutting operation, said frame maintaining means being:

bearing means provided on one end of said guide member and adapted to engage horizontal ground; and bearing means provided on the side of the second frame remote from the rotatable plate, and adapted for engaging a vertical wall of rock, whereby the frame is maintainable in a fixed position under pressure between the fixable automobile vehicle, the ground, and vertical wall.

2. A machine according to claim 1, wherein the rotary plate supporting the first frame of the sawing unit is connected to the swingle-bar by means of pins and by a trim adjusting cylinder.

3. A machine according to claim 1, wherein the sawing unit includes a second motor for pivoting the sawing chain.

4. A machine according to claim 1, wherein the sawing unit is carried by a body which is a part of said second frame and rigidly connected through said cross beams to the frame supported by the rotating plate.

5. A machine according to claim 1, wherein the boom is pivotally mounted on a yoke connected to an automobile body through the rotary plate.

6. A machine according to claim 1, wherein the sawing unit is an hydraulic type sawing unit fed from a same hydraulic central unit as said adjusting means.

* * * * *